US007063631B2

(12) United States Patent
Iwami

(10) Patent No.: US 7,063,631 B2
(45) Date of Patent: Jun. 20, 2006

(54) GOLF BALL

(75) Inventor: Satoshi Iwami, Kobe (JP)

(73) Assignee: SRI Sports, Ltd., Kobe (JP)

( * ) Notice: Subject to any disclaimer, the term of this patent is extended or adjusted under 35 U.S.C. 154(b) by 0 days.

(21) Appl. No.: 10/802,839

(22) Filed: Mar. 18, 2004

(65) Prior Publication Data

US 2004/0185965 A1 Sep. 23, 2004

(30) Foreign Application Priority Data

Mar. 20, 2003 (JP) ..... 2003-078254

(51) Int. Cl.
*A63B 37/06* (2006.01)

(52) U.S. Cl. ..... 473/378

(58) Field of Classification Search ..... 473/378, 473/351, 368, 367
See application file for complete search history.

(56) References Cited

U.S. PATENT DOCUMENTS

| | | | | |
|---|---|---|---|---|
| 5,037,104 | A * | 8/1991 | Watanabe et al. | 473/354 |
| 6,379,266 | B1 | 4/2002 | Ogg et al. | |
| 6,638,185 | B1 * | 10/2003 | Kennedy et al. | 473/374 |
| 6,652,393 | B1 * | 11/2003 | Watanabe | 473/377 |
| 2003/0158340 | A1 * | 8/2003 | Iwami | 525/184 |

FOREIGN PATENT DOCUMENTS

| | | | |
|---|---|---|---|
| EP | 001068883 | A2 * | 1/2001 |
| JP | 2000-102628 | A | 4/2000 |
| JP | 2001070478 | * | 3/2001 |
| JP | 2001-299965 | A | 10/2001 |

* cited by examiner

*Primary Examiner*—Raeann Gorden
(74) *Attorney, Agent, or Firm*—Birch, Stewart, Kolasch & Birch, LLP

(57) ABSTRACT

The present invention provides a golf ball having excellent scuff resistance. The present invention relates to a golf ball comprising at least one layer of a core and a cover covering the core, wherein the cover is formed from a material having a value of the maximum load of 1.5 to 3.0 kN at an impact energy of 47.3 J in penetration and impact fatigue tests.

6 Claims, 1 Drawing Sheet

GOLF BALL

This Nonprovisional application claims priority under 35 U.S.C. 119(a) on Patent Application No(s). 2003-078254 filed in JAPAN on Mar. 20, 2003, the entire contents of which are hereby incorporated by reference.

FIELD OF THE INVENTION

The present invention relates to a golf ball. More particularly, it relates to a golf ball having excellent scuff resistance.

BACKGROUND OF THE INVENTION

Recently, ionomer resin has been widely used for cover material of golf balls. This is because the ionomer resin is superior in rebound characteristics, durability, processability and the like. However, since the ionomer resin has high rigidity and hardness, there are problems that in the resulting golf ball, shot feel is hard and poor; and spin performance is not sufficiently obtained, which degrades controllability, when using ionomer resin as the cover material.

In order to improve the problems, it is proposed to soften the cover by blending the hard ionomer resin having high rigidity with terpolymer-based soft ionomer resin. However, when good shot feel and spin performance are accomplished in case of the blend of the hard ionomer with the soft ionomer resin is used, rebound characteristics of the resulting golf ball are largely degraded. In addition, since the surface of the cover of the golf ball is easily abraded by grooves on a face surface of the golf club when hit by an iron club, it is problem that the surface of the golf ball becomes fluffy or begins to split finely, and scuff resistance (chunking resistance) is poor.

In order to solve the problems, it has been proposed to use thermosetting polyurethane composition or a blend of ionomer resin with polyethylene as a cover material of golf ball (Japanese Patent Kokai publication Nos. 102628/2000, 299965/2001 and the like).

In Japanese Patent Kokai publication No. 102628/2000, a cover material for golf ball comprising heat mixture of (a) ionomer resin, (b) polyethylene and (c) epoxy group modified polyolefin, as a main component, is disclosed. By using the cover material, dispersibility of the polyethylene in the ionomer resin is improved, which improves the wear resistance, but scuff resistance is not sufficiently obtained.

In Japanese Patent Kokai publication No. 299965/2001, a golf ball comprising a core, a boundary layer covering the core, a wound layer covering the boundary layer, and a cover covering the wound layer is disclosed. The boundary layer comprises thermoplastic material having a Shore D hardness of 40 to 85, and the cover comprises polyurethane material. The polyurethane layer is formed from cured article of a thermosetting polyurethane composition comprising p-phenylene diisocyanate. When the thermosetting polyurethane composition is used for the cover material, compared with the blend of the hard ionomer with the soft ionomer resin, the scuff resistance is excellent, but is not sufficiently obtained. In addition, since a process of covering a cover on a core is complicated, large-scale production is difficult, and the productivity is degraded.

In Japanese Patent Kokai publication Nos. 102628/2000 and 299965/2001, the cover is designed to have excellent scuff resistance in view of a formulation and wear of the cover material. However, a golf ball, of which the scuff resistance is not sufficiently obtained, is present even if it satisfies the factors. In Japanese Patent Kokai publication Nos. 102628/2000, the wear is reduced by using the above cover material in order to improve the scuff resistance. However, the low wear material is not always the material having excellent scuff resistance. When hit the golf ball by an iron club, grooves on a face surface of the iron club is cut into the surface of the golf ball (cover and paint layer) to bite off it, and the scuff phenomenon occurs. It is considered that the scuff phenomenon is different from the wear of the surface of the golf ball. The golf ball having excellent scuff resistance is not obtained by checking only the wear resistance as a evaluation item when developing the golf ball. Therefore, an index based on the scuff phenomenon is required when developing the golf ball having excellent scuff resistance.

OBJECTS OF THE INVENTION

A main object of the present invention is to provide a golf ball having excellent scuff resistance.

According to the present invention, the object described above has been accomplished by adjusting the value of the maximum load at an impact energy of 47.3 J in penetration and impact fatigue tests of the cover to a specified range, thereby providing a golf ball having excellent scuff resistance.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
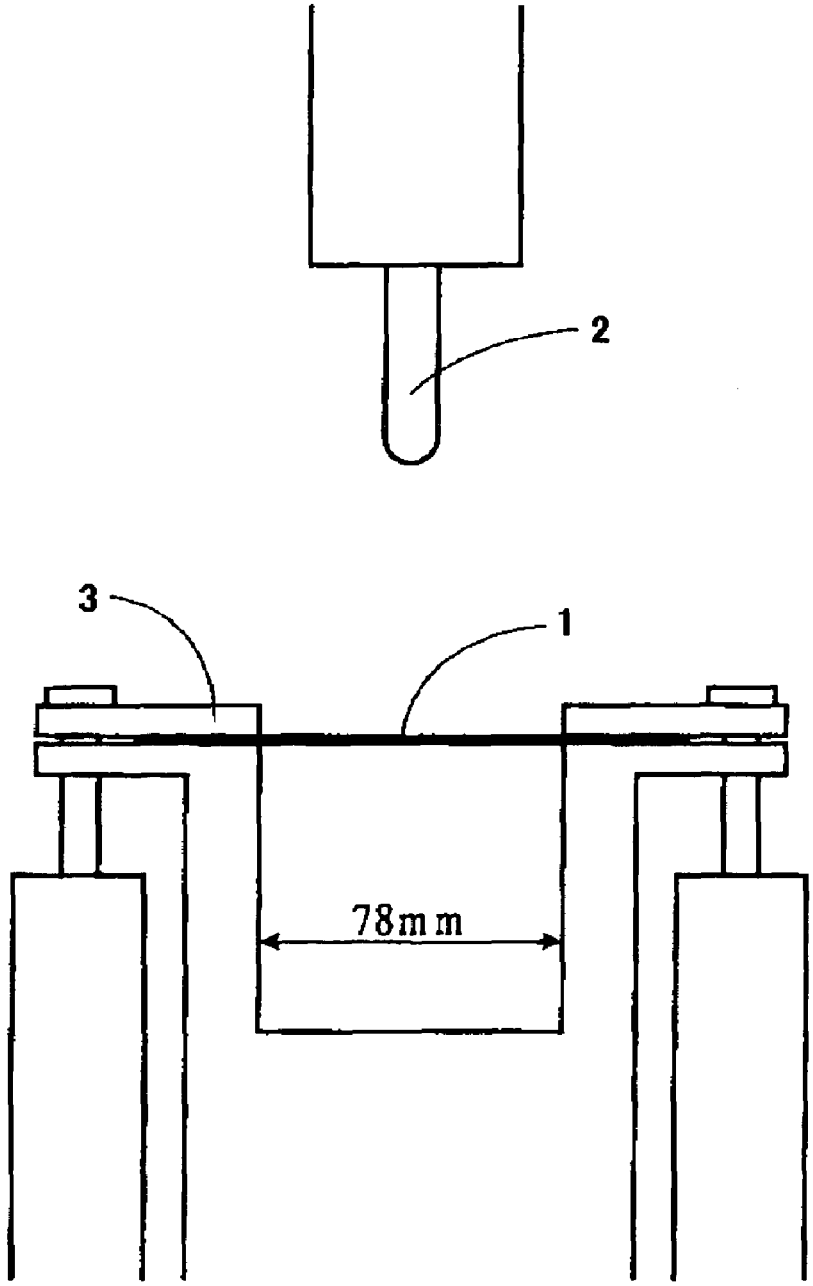
FIG. 1 is a schematic cross section of an equipment for penetration and impact fatigue tests explaining a measuring method of penetration and impact fatigue tests of the present invention.

The present invention relates to a golf ball comprising at least one layer of a core and a cover covering the core, wherein the cover is formed from a material having a value of the maximum load of 1.5 to 3.0 kN at an impact energy of 47.3 J in penetration and impact fatigue tests.

The present inventors have studied a mode of the actual scuff phenomenon. As a result, it is considered that the scuff occurs in a penetration mode, and they noticed penetration and impact fatigue properties. Therefore, it was apparent that a value of the maximum load in penetration and impact fatigue tests closely correlate with scuff resistance. There have been golf balls, of which the cover is designed in view of a formulation and wear of the cover material, in the prior art as described above. It is possible in some degree to improve the scuff resistance by using the cover material of Japanese Patent Kokai publication No. 102628/2000, or by using the cover material of Japanese Patent Kokai publication No. 299965/2001 to reduce the wear amount. However, there were golf balls, of which the scuff resistance is not sufficiently obtained, among the golf balls obtained by using the above cover materials, and there was no index based on the scuff phenomenon. Therefore, in the present invention, it was found that the golf ball having excellent scuff resistance was obtained by adjusting the value of the maximum load at an impact energy of 47.3 J in penetration and impact fatigue tests of the cover to a specified range. In the present invention, penetration mode, which is not tensile mode, is selected in impact test, because it is considered that the penetration mode is similar to impact phenomenon when hit the golf ball by an iron club.

In order to put the present invention into a more suitable practical application, it is desired that the cover have a thickness of 0.2 to 1.5 mm and a hardness in Shore D hardness of 30 to 55.

DETAILED DESCRIPTION OF THE INVENTION

The golf ball of the present invention will be explained in detail hereinafter. The golf ball of the present invention comprises a core and a cover formed on the core. The core may be the same one that has been conventionally used for solid golf, and may be obtained by mixing a rubber composition using a proper mixer, such as a mixing roll, and then vulcanizing and press-molding under applied heat the rubber composition in a mold into a spherical form. The rubber composition comprises 10 to 60 parts by weight of a vulcanizing agent (crosslinking agent), for example, α,β-unsaturated carboxylic acid (such as acrylic acid, methacrylic acid, etc.) or mono or divalent metal salts, such as zinc or magnesium salts thereof, or a functional monomer such as trimethylolpropane trimethacrylate, or a combination thereof;

0.5 to 5 parts by weight of co-crosslinking initiator such as organic peroxides;

10 to 30 parts by weight of filler such as zinc oxide, barium sulfate and the like; and optionally organic sulfide compound, antioxidant and the like, based on 100 parts by weight of a base rubber such as cis-1,4-polybutadiene rubber. The vulcanization may be conducted, for example, by press molding in a mold at 130 to 240° C. and 2.9 to 11.8 MPa for 15 to 60 minutes. It is preferable for the surface of the resulting core to be buffed to improve the adhesion to the cover layer formed on the core. However, such core is given by way of illustrative examples only, and the invention shall not be limited thereto.

The core may have single-layered structure or multi-layered structure, which has two or more layers. When the core has multi-layered structure, the inmost layer thereof is preferably formed from the rubber composition comprising cis-1,4-polybutadiene, but the other layer thereof may be formed from resins such as thermoplastic resin as a base resin.

In the golf ball of the present invention, it is desired that the core have a diameter of 38.8 to 42.2 mm, preferably 39.6 to 42.0 mm, more preferably 40.0 to 41.2 mm. When the diameter of the core is smaller than 38.8 mm, the cover is thick, and the rebound characteristics are degraded. On the other hand, when the diameter is larger than 42.2 mm, the thickness of the cover is too thin, and the technical effects accomplished by the presence of the cover are not sufficiently obtained. In addition, it is difficult to mold it.

In the golf ball of the present invention, it is desired for the core to have a deformation amount when applying from an initial load of 98 N to a final load of 1275 N of 2.5 to 4.5 mm, preferably 2.6 to 4.2 mm, more preferably 2.7 to 4.0 mm. When the deformation amount is smaller than 2.5 mm or larger than 4.5 mm, it is difficult to adjust a deformation amount of the resulting golf ball to a proper range, which degrades its shot feel or flight distance.

In the golf ball of the present invention, it is advantage in view of flight distance when hit by a driver or middle iron club for the core to have a hardness distribution such that the center point is the softest and the outer portion has higher hardness in order, and it is desired for the core to have a hardness difference in Shore D hardness between the center hardness and surface hardness of 15 to 45, preferably 18 to 40, more preferably 20 to 40. When the hardness difference is smaller than 15, the flight performance of the resulting golf ball is proper, which reduces the flight distance. On the other hand, when the hardness difference is larger than 45, the durability of the resulting golf ball is degraded.

In the golf ball of the present invention, it is desired for the core to have the center hardness in Shore D hardness of 20 to 50, preferably 30 to 45. When the center hardness is lower than 20, it is difficult to adjust a deformation amount of the core to a proper range, and rebound characteristics of the resulting golf ball are degraded. On the other hand, when the center hardness is higher than 50, the hardness difference from the surface of the core is too small, which degrades its shot feel or flight distance of the resulting golf ball.

In the golf ball of the present invention, it is desired for the core to have the surface hardness in Shore D hardness of 45 to 72, preferably 50 to 70, more preferably 50 to 68. When the hardness is lower than 45, it is difficult to adjust a deformation amount of the core to a proper range, and rebound characteristics of the resulting golf ball are degraded. On the other hand, when the hardness is higher than 72, the core is too hard, and the shot feel is hard and poor. The term "a surface hardness of the core" as used herein refers to the hardness, which is determined by measuring a hardness at the surface of the outmost layer in the whole core, whether the core has single-layered structure or multi-layered structure. The term "a center hardness of the core" as used herein refers to the hardness, which is obtained by cutting the core into two equal parts and then measuring a hardness at the center point in section.

When the core of the present invention has multi-layered structure comprising an inner core and at least one layer of an outer core, the outer core may be formed from the rubber composition as used in the inner core, or from thermoplastic resin, particularly ionomer resin, which can be typically used for the cover of golf balls, as a base resin. The ionomer resin may be a copolymer of α,β-olefin and α,β-unsaturated carboxylic acid, of which a portion of carboxylic acid groups is neutralized with metal ion, or a terpolymer of α-olefin, α,β-unsaturated carboxylic acid and α,β-unsaturated carboxylic acid ester, of which a portion of carboxylic acid groups is neutralized with metal ion. Examples of the α-olefins in the ionomer preferably include ethylene, propylene and the like. Examples of the α,β-unsaturated carboxylic acid in the ionomer include acrylic acid, methacrylic acid, fumaric acid, maleic acid, crotonic acid and the like, and preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum ion, a neodymium ion and the like;

and mixture thereof. Preferred are sodium ions, zinc ions, lithium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1601, Hi-milan 1605, Hi-milan 1652, Hi-milan 1702, Hi-milan 1705, Hi-milan 1706, Hi-milan 1707, Hi-milan 1855, Hi-milan 1856, Hi-milan AM7316 and the like. Examples of the ionomer resins, which are commercially available from Du Pont Co., include Surlyn 8945, Surlyn 9945, Surlyn 6320, Surlyn 8320, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the outer core of the present invention, the above ionomer resin may be used alone, but the ionomer resin may be used in combination with at least one of thermoplastic elastomer, diene-based block copolymer and the like. Examples of the thermoplastic elastomers include polyamide-based thermoplastic elastomer, which is commercially available from Atofina Japan Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based elastomer, which is commercially available from BASF Japan Co., Ltd. under the trade name of "Elastollan" (such as "Elastollan ET880"); and the like.

The diene-based block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010"), the diene block copolymers, which are commercially available from Kuraray Co., Ltd. under the trade name of "Septon" (such as "Septon HG-252") and the like.

The amount of the thermoplastic elastomer or diene block copolymer is 1 to 60 parts by weight, preferably 1 to 35 parts by weight, based on 100 parts by weight of the base resin for the cover. When the amount is smaller than 1 part by weight, the technical effect of improving the shot feel of the golf ball is not sufficiently obtained. On the other hand, when the amount is larger than 60 parts by weight, the intermediate layer is too soft, and the rebound characteristics of the resulting golf ball are degraded. In addition, the compatibility with the ionomer resin is degraded, and the durability is degraded.

When the core has multi-layered structure and the outer core is formed from the rubber composition, the rubber composition for the outer core is mixed, and coated on the inner core into a concentric sphere, and then vulcanized by press-molding at 160 to 180° C. for 10 to 20 minutes in the mold to obtain a core, which is formed by covering the outer core on the inner core. When the core has multi-layered structure and the outer core is formed from thermoplastic resin, the resin composition for the outer core is directly injection molded on the inner core to obtain the core. It is preferable for the surface of the resulting core to be buffed to improve the adhesion to the cover formed on the core. The cover is then covered on the core.

In the golf ball of the present invention, it is required for the cover to have a value of the maximum load of 1.5 to 3.0 kN at an impact energy of 47.3 J in penetration and impact fatigue tests, preferably 1.6 to 2.7 kN, more preferably 1.6 to 2.5 kN. When the value of the maximum load is smaller than 1.5 kN, it is easy to cause scuff phenomenon, which the cover material is bitten off by grooves on a face surface of the iron club, and the scuff resistance is poor. On the other and, when the value of the maximum load is larger than 3.0 kN, it is difficult to adjust the cover to a desired hardness. In the present invention, the impact energy of 47.3 J is selected in the penetration and impact fatigue tests in order to completely penetrate the sample.

The value of the maximum load in the penetration and impact fatigue tests is determined by conducting penetration and impact fatigue tests, using a sample having a size of 100 mm×100 mm×3 mm cut out from a heat and press molded sheet (slab) having a thickness of about 3 mm from the cover composition with a drop weight type impact test equipment, "Dynatup-8250" manufactured by General Research Co. shown in FIG. 1. The sample is completely clamped with a support ring having an inner diameter of 78 mm, and a striker is dropped at an impact speed of 4 m/sec to penetrate the sample. The striker used has half-spherical tip shape, a total weight of 5.91 kg and a diameter of the tip of 10 mm. The test temperature is 23° C. The value of the maximum load at an impact energy of 47.3 J is determined by measuring a load, energy and displacement of the striker (elongation) by computerization.

A material for the cover used in the golf ball of the present invention is not limited as long as the cover is formed from a material having a specified range of a value of the maximum load at an impact energy of 47.3 J in penetration and impact fatigue tests, but is selected from the group consisting of polyurethane-based thermoplastic elastomer; thermosetting polyurethane composition; polybutadiene rubber, such as cis-1,4-polybutadiene; rubber composition comprising cis-1,4-polybutadiene as a base rubber as used in the core; thermoplastic elastomer other than polyurethane-based thermoplastic elastomer; and mixtures thereof. Preferred are polyurethane-based thermoplastic elastomer and the rubber composition in view of scuff resistance and controllability.

Concrete examples of the materials for the cover include polyurethane-based elastomer, which is commercially available from BASF Japan Co., Ltd. under the trade name of "Elastollan" (such as "Elastollan XNY597A", "Elastollan XNY97A" and "Elastollan ET590"); high-cis polybutadiene, which is commercially available from JSR Co., Ltd.

under the trade name "BR-18"; and mixtures thereof. Example of the rubber composition includes the rubber composition for the core as described above.

The composition for the cover used in the present invention may optionally contain fillers (such as barium sulfate), pigments (such as titanium dioxide) and the other additives such as a dispersant, an antioxidant, a UV absorber, a photostabilizer and a fluorescent agent or a fluorescent brightener, etc., in addition to the base resin for the cover as long as the addition of the additives does not deteriorate the desired performance of the golf ball cover. If used, the amount of the pigment is preferably 0.1 to 5.0 parts by weight, based on 100 parts by weight of the base resin for the cover.

A method of covering on the core with the cover is not specifically limited, but may be a conventional method. For example, there can be used a method comprising molding the cover composition into a semi-spherical half-shell in advance, covering the core with the two half-shells, followed by press molding, or a method comprising injection molding the cover composition directly on the core, which is covered with the cover, to cover it. Preferred is injection molding in view of moldability.

In the golf ball of the present invention, it is desired for the cover to have a thickness of 0.2 to 1.5 mm, preferably 0.5 to 1.5 mm, more preferably 0.8 to 1.4 mm. When the thickness is smaller than 0.2 mm, the cover is too thin, and the durability is degraded. In addition, it is difficult to mold the cover. On the other hand, when the thickness is larger than 1.5 mm, the rebound characteristics of the resulting golf ball are degraded, which reduces the flight distance.

In golf ball of the present invention, it is desired for the cover to have a hardness in Shore D hardness of 30 to 55, preferably 32 to 52, more preferably 35 to 50. When the cover hardness is lower than 30, the cover is too soft, and the rebound characteristics of the resulting golf ball are degraded. On the other hand, when the cover hardness is higher than 55, the cover is too hard, and the spin amount at approach shot is too small, which degrades the controllability. The term "a cover hardness" as used herein refers to the hardness measured using a sample of a stack of the three or more heat and press molded sheets having a thickness of about 2 mm from the cover composition, which had been stored at 23° C. for 2 weeks.

At the time of molding the cover, many depressions called "dimples" are formed on the surface of the golf ball. Furthermore, paint finishing or marking with a stamp may be optionally provided after the cover is molded for commercial purposes. The golf ball of the present invention is formed, so that it has a diameter of not less than 42.67 mm (preferably 42.67 to 42.82 mm) and a weight of not more than 45.93 g, in accordance with the regulations for golf balls.

In the golf ball of the present invention, it is desired to have a deformation amount when applying from an initial load of 98 N to a final load of 1275 N of 2.5 to 3.5 mm, preferably 2.5 to 3.2 mm, more preferably 2.6 to 3.0 mm. When the deformation amount is smaller than 2.5 mm, the golf ball is too hard, and the shot feel is hard and poor. On the other hand, when the deformation amount is larger than 3.5 mm, the golf ball is too soft, and the shot feel is heavy and poor.

EXAMPLES

The following Examples and Comparative Examples further illustrate the present invention in detail but are not to be construed to limit the scope of the present invention.

Production of Core (Core A)

The rubber composition for the core having the formulation shown in Table 1 was mixed, and then vulcanized by press-molding at 170° C. for 15 minutes in the mold to obtain spherical core having a diameter of 40.0 mm.

(Core B)

(i) Production of Inner Core

The rubber composition for the inner core having the formulation shown in Table 1 was mixed, and then vulcanized by press-molding at 170° C. for 15 minutes in the mold to obtain spherical inner core having a diameter of 37.0 mm.

(ii) Production of Two-Layer Structured Core

The composition for the outer core having the formulation shown in Table 1 was directly injection molded on the inner core produced in the step (i) to obtain two-layer structured core having a diameter of 40.0 mm.

(Cores C and D)

(i) Production of Inner Core

The rubber composition for the inner core having the formulation shown in Table 1 was mixed, and then vulcanized by press-molding at 170° C. for 15 minutes in the mold to obtain spherical inner core having a diameter of 32.5 mm.

(ii) Production of Two-Layer Structured Core

The rubber composition for the outer core having the formulation shown in Table 1 was mixed, and coated on the inner core produced in the step (i) into a concentric sphere, and then vulcanized by press-molding at 170° C. for 15 minutes in the mold to obtain two-layer structured core having a diameter of 40.0 mm.

The deformation amount, center hardness (a) and surface hardness (b) of the resulting single-layer structured core and two-layer structured core were measured. The hardness difference (b−a) was calculated from the center hardness (a) and surface hardness (b). The results are shown in the same Table.

TABLE 1

| | (parts by weight) | | | |
|---|---|---|---|---|
| Core composition | A | B | C | D |
| (Core or inner core) | | | | |
| BR-18 *1 | 100 | 100 | 100 | 100 |
| Zinc acrylate | 33 | 33 | 33 | 33 |
| Zinc oxide | 12.0 | 14.0 | 7.5 | 12.6 |
| Dicumyl peroxide *2 | 1.0 | 1.0 | 0.8 | 0.8 |
| Diphenyl disulfide *3 | 0.5 | 0.5 | 0.5 | 0.5 |
| (Outer core) | | | | |
| BR-18 *1 | — | — | 100 | 100 |
| Zinc acrylate | | — | 37 | 41 |
| Zinc oxide | | — | 11.0 | 8.9 |
| Dicumyl peroxide *2 | | — | 0.7 | 0.7 |
| Diphenyl disulfide *3 | | — | 0.5 | 0.5 |
| Hi-milan 1605 *4 | | 50 | — | — |
| Hi-milan 1706 *5 | | 50 | — | — |
| Deformation amount (mm) | 2.85 | 2.60 | 2.70 | 2.80 |

TABLE 1-continued

| Core composition | | (parts by weight) A | B | C | D |
|---|---|---|---|---|---|
| Hardness (Shore D) | Center (a) | 37 | 38 | 39 | 40 |
| | Surface (b) | 55 | 70 | 52 | 56 |
| | Difference (b − a) | 18 | 32 | 13 | 16 |

*1: High-cis polybutadiene commercially available from JSR Co., Ltd., under the trade name "BR-18" (Content of cis-1,4-polybutadiene = 96%)
*2: Dicumyl peroxide, commercially available from Nippon Oil & Fats Co., Ltd. under the trade name of "Percumyl D"
*3: Diphenyl disulfide, commercially available from Sumitomo Seika Co., Ltd.
*4: Hi-milan 1605 (trade name), ethylene-methacrylic acid copolymer ionomer resin obtained by neutralizing with sodium ion, manufactured by Du Pont-Mitsui Polychemicals Co., Ltd.
*5: Hi-milan 1706 (trade name), ethylene-methacrylic acid copolymer ionomer resin obtained by neutralizing with zinc ion, manufactured by Du Pont-Mitsui Polychemicals Co., Ltd.

Preparation of Cover Compositions

The formulation materials for the cover showed in Tables 2 to 4 were mixed using a kneading type twin-screw extruder to obtain pelletized intermediate layer and cover compositions. The extrusion condition was, a screw diameter of 45 mm,
a screw speed of 200 rpm, and
a screw L/D of 35.

The formulation materials were heated at 200 to 260° C. at the die position of the extruder. The value of the maximum load in penetration and impact fatigue tests of the cover was determined by penetration and impact fatigue tests, using a sample having a size of 100 mm×100 mm×3 mm cut out from a heat and press molded sheet (slab) having a thickness of about 3 mm from the cover composition, with a drop weight type impact test equipment, "Dynatup-8250" manufactured by General Research Co. The cover hardness was measured using a Shore D hardness meter according to ASTM-D2240, using a sample of a stack of the three or more heat and press molded sheets having a thickness of about 2 mm from the resulting cover compositions, which had been stored at 23° C. for 2 weeks. The results are shown in Tables 2 to 7.

TABLE 2

| Cover composition | I | II | III | IV |
|---|---|---|---|---|
| Elastollan XNY597A *6 | 100 | 50 | — | — |
| Elastollan XNY97A *7 | — | 50 | — | — |
| Elastollan ET590 *8 | — | — | 100 | — |
| Elastollan S90A *9 | — | — | — | 100 |
| Pelprene P150M *10 | — | — | — | — |
| Pelprene P75M *11 | — | — | — | — |
| RB820 *12 | — | — | — | — |
| BR-18 *1 | — | — | — | — |
| Rubber composition *13 | — | — | — | — |
| Titanium dioxide | 2 | 2 | 2 | 2 |
| Slab hardness (Shore D) | 48 | 48 | 43 | 42 |
| Scuff resistance | 4 | 4 | 3 | 2 |
| Maximum load (kN) | 1.9 | 1.9 | 1.6 | 1.3 |

TABLE 3

| Cover composition | V | VI | VII | VIII |
|---|---|---|---|---|
| Elastollan XNY597A *6 | — | — | 80 | — |
| Elastollan XNY97A *7 | — | — | — | — |

TABLE 3-continued

| Cover composition | V | VI | VII | VIII |
|---|---|---|---|---|
| Elastollan ET590 *8 | — | — | — | — |
| Elastollan S90A *9 | — | — | — | — |
| Pelprene P150M *10 | 70 | — | — | — |
| Pelprene P75M *11 | 30 | — | — | — |
| RB820 *12 | — | 100 | — | — |
| BR-18 *1 | — | — | 20 | — |
| Rubber composition *13 | — | — | — | 100 |
| Titanium dioxide | 2 | 2 | 2 | 2 |
| Slab hardness (Shore D) | 45 | 30 | 42 | 45 |
| Scuff resistance | 1 | 1 | 4 | 5 |
| Maximum load (kN) | 0.9 | 0.8 | 2.0 | 2.5 |

*6: Elastollan XNY97A (trade name), polyurethane-based thermoplastic elastomer formed by using 4,4'-dicyclohexylmethane diisocyanate ($H_{12}$MDI)-polyoxytetramethylene glycol (PTMG), commercially available from BASF Japan Co., Ltd.; Shore A (JIS-A) hardness = 97
*7: Elastollan XNY597A (trade name), polyurethane-based thermoplastic elastomer formed by using 4,4'-dicyclohexylmethane diisocyanate ($H_{12}$MDI)-adipate, commercially available from BASF Japan Co., Ltd.; Shore A (JIS-A) hardness = 97
*8: Elastollan ET590 (trade name), polyurethane-based thermoplastic elastomer formed by using 4,4'-diphenylmethane diisocyanate (MDI)-adipate, commercially available from BASF Japan Co., Ltd.; Shore A (JIS-A) hardness = 90, clear polyester grade, low crystallinity
*9: Elastollan S90A (trade name), polyurethane-based thermoplastic elastomer formed by using 4,4'-diphenylmethane diisocyanate (MDI)-adipate, commercially available from BASF Japan Co., Ltd.; Shore A (JIS-A) hardness = 90, general-purpose grade, high crystallinity
*10: Pelprene P150M (trade name), polyester-based thermoplastic elastomer (unmodified) commercially available from Toyobo Co., Ltd., Shore D hardness: 50
*11: Pelprene P75M (trade name), polyester-based thermoplastic elastomer (unmodified) commercially available from Toyobo Co., Ltd., Shore D hardness: 39
*12: RB820 (trade name), syndiotactic 1,2-polybutadiene, commercially available from JSR Co., Ltd.
*13: The core composition A shown in Table 1

TABLE 4

| Cover composition | IX | X | XI | XII | XIII | XIV |
|---|---|---|---|---|---|---|
| Rabalon MJ9300 *14 | 100 | — | — | — | — | — |
| Daiamid E47 *15 | — | 100 | — | — | — | — |
| Surlyn 8320 *16 | — | — | 100 | 50 | — | — |
| Hi-milan AM7311 *17 | — | — | — | 50 | — | — |
| PPDI-based thermosetting urethane *18 | — | — | — | — | 100 | — |
| Elastollan XNY85A *19 | — | — | — | — | — | 100 |
| Titanium dioxide | 2 | 2 | 2 | 2 | 2 | 2 |
| Slab hardness (Shore D) | 44 | 47 | 37 | 51 | 47 | 35 |
| Scuff resistance | 2 | 2 | 2 | 2 | 2 | 5 |
| Maximum load (kN) | 1.2 | 1.0 | 1.1 | 1.2 | 1.1 | 3.0 |

*14: Rabalon MJ9300 (trade name), styrene-based thermoplastic elastomer, manufactured by Mitsubishi Chemical Co., Ltd., Shore A (JIS-A) hardness = 93
*15: Daiamid E47 (trade name), polyamide-based thermoplastic elastomer, commercially available from Daicel-Huels Co., Ltd., Shore D hardness = 47
*16: Surlyn 8320 (trade name), ethylene-methacrylic acid-acrylic acid ester terpolymer ionomer resin obtained by neutralizing with sodium ion, manufactured by Du Pont Co.; Shore D hardness = 37
*17: Hi-milan AM7311 (trade name), ethylene-methacrylic acid copolymer ionomer resin obtained by neutralizing with magnesium ion, manufactured by Du Pont-Mitsui Polychemicals Co., Ltd.; Shore D hardness = 63
*18: p-phenylene diisocyanate (PPDI)/1,4-butane diol-based polyurethane prepolymer, commercially available from Uniroyal Chemical Co., Shore D hardness = 63
*19: Elastollan XNY85A (trade name), polyurethane-based thermoplastic elastomer formed by using 4,4'-dicyclohexylmethane diisocyanate ($H_{12}$MDI)-PTMG, commercially available from BASF Japan Co., Ltd.; Shore A (JIS-A) hardness = 85

Examples 1 to 9 and Comparative Examples 1 to 8

The resulting cover composition was injection molded into a semi-spherical half-shell for the cover, and the core was covered with the two half-shells, followed by press molding it in a mold having dimples at 145° C. for 3 minutes 40 seconds, to form a cover layer having a thickness of 0.8 mm. After deflashing, paint was applied on the surface to obtain golf ball having a diameter of 42.8 mm and a weight of 45.4 g. With respect to the resulting golf balls, the deformation amount and scuff resistance were measured. The results are shown in the Tables 5 to 7. The test methods are as follows.

TEST METHODS (1) Deformation Amount

The deformation amount of the center or golf ball was determined by measuring a deformation amount when applying from an initial load of 98 N to a final load of 1275 N on the center or golf ball.

(2) Cover Hardness

The cover hardness was determined by measuring a Shore D hardness, using a sample of a stack of the three or more heat and press molded sheets (slab) having a thickness of about 2 mm from the cover composition, which had been stored at 23° C. for 2 weeks. The Shore D hardness was measured by using an automatic rubber hardness tester (type LAl), which is commercially available from Kobunshi Keiki Co., Ltd., with a Shore D hardness meter according to ASTM D 2240.

(3) Penetration and Impact Fatigue Tests

The penetration and impact fatigue tests were conducted by using a drop weight type impact test equipment, "Dynatup-8250" manufactured by General Research Co. shown in FIG. 1. A sample having a size of 100 mm×100 mm×3 mm was completely clamped with a support ring having an inner diameter of 78 mm, and a striker was dropped at an impact speed of 4 m/sec to penetrate the sample. The striker used has half-spherical tip shape, a total weight of 5.91 kg and a diameter of the tip of 10 mm. The test temperature is 23° C. The value of the maximum load at an impact energy of 47.3 J is determined by measuring a load, energy and displacement of the striker (elongation) by computerization. The result is shown as the value of the maximum load of each cover in the penetration and impact fatigue tests.

(4) Scuff Resistance

After a pitching wedge (PW) commercially available was mounted to a swing robot manufactured by True Temper Co., two points on the surface of each golf ball was hit at a head speed of 36 m/sec one time for each point. The two points were evaluated by checking the surface appearance by visual observation. The evaluation criteria are as follows.

Evaluation Criteria o: The surface of the golf ball slightly has a cut, but it is not particularly noticeable.

Δ: The surface of the golf ball clearly has a cut, and the surface becomes fluffy.

x: The surface of the golf ball is considerably chipped off, and the surface noticeably becomes fluffy.

Test Results

TABLE 5

| | Example No. | | | | | |
|---|---|---|---|---|---|---|
| Test item | 1 | 2 | 3 | 4 | 5 | 6 |
| (Core) | | | | | | |
| Composition | A | B | C | D | D | D |
| Diameter (mm) | 40.0 | 40.0 | 40.0 | 41.2 | 41.2 | 41.2 |
| (Cover) | | | | | | |
| Composition | I | I | I | I | II | III |
| Hardness (Shore D) | 48 | 48 | 48 | 48 | 48 | 43 |
| Thickness (mm) | 1.4 | 1.4 | 1.4 | 0.8 | 0.8 | 0.8 |
| Maximum load (kN) | 1.9 | 1.9 | 1.9 | 1.9 | 1.9 | 1.6 |
| (Golf ball) | | | | | | |
| Deformation amount (mm) | 2.69 | 2.47 | 2.58 | 2.68 | 2.66 | 2.73 |
| Scuff resistance | 4 | 4 | 4 | 4 | 4 | 3 |

TABLE 6

| | Example No. | | | Comparative Example No. | | |
|---|---|---|---|---|---|---|
| Test item | 7 | 8 | 9 | 1 | 2 | 3 |
| (Core) | | | | | | |
| Composition | D | D | D | D | D | D |
| Diameter (mm) | 41.2 | 41.2 | 41.2 | 41.2 | 41.2 | 41.2 |
| (Cover) | | | | | | |
| Composition | VII | VIII | XIV | IV | V | VI |
| Hardness (Shore D) | 42 | 45 | 35 | 42 | 45 | 30 |
| Thickness (mm) | 0.8 | 0.8 | 0.8 | 0.8 | 0.8 | 0.8 |
| Maximum load (kN) | 2.0 | 2.5 | 3.0 | 1.3 | 0.9 | 0.8 |
| (Golf ball) | | | | | | |
| Deformation amount (mm) | 2.75 | 2.67 | 2.80 | 2.76 | 2.71 | 2.83 |
| Scuff resistance | 4 | 5 | 5 | 2 | 1 | 1 |

TABLE 7

| | Comparative Example No. | | | | |
|---|---|---|---|---|---|
| Test item | 4 | 5 | 6 | 7 | 8 |
| (Core) | | | | | |
| Composition | D | D | D | D | D |
| Diameter (mm) | 41.2 | 41.2 | 41.2 | 41.2 | 41.2 |
| (Cover) | | | | | |
| Composition | IX | X | XI | XII | XIII |
| Hardness (Shore D) | 44 | 47 | 37 | 51 | 47 |
| Thickness (mm) | 0.8 | 0.8 | 0.8 | 0.8 | 0.8 |
| Maximum load (kN) | 1.2 | 1.0 | 1.1 | 1.2 | 1.1 |
| (Golf ball) | | | | | |
| Deformation amount (mm) | 2.73 | 2.68 | 2.82 | 2.63 | 2.68 |
| Scuff resistance | 2 | 2 | 2 | 2 | 2 |

As is apparent from Tables 5 to 7, since the golf balls of Examples 1 to 9 of the present invention, when compared with the golf balls of Comparative Examples 1 to 8, have large value of the maximum load at an impact energy of 47.3 J in the penetration and impact fatigue tests, it is difficult to cause scuff phenomenon, which the surface of the golf ball is bitten off by grooves on a face surface of the iron club, and the cover is tough. Therefore, the golf balls of the present invention have good scuff resistance.

On the other hand, in the golf balls of Comparative Examples 1 to 8, since the value of the maximum load at an impact energy of 47.3 J in the penetration and impact fatigue tests is small, and the scuff resistance is very poor.

What is claimed is:

1. A golf ball comprising at least one layer of a core and a cover covering the core, wherein the cover is formed from a material having a value of the maximum load of 1.5 to 3.0 kN at an impact energy of 47.3 J in penetration and impact fatigue tests, and the cover material is selected from the group consisting of polyurethane-based thermoplastic elastomer; thermosetting polyurethane composition; thermoplastic elastomer other than polyurethane-based thermoplastic elastomer; and mixtures thereof, an innermost layer of the core being formed from a rubber composition comprising cis-1,4-polybutadiene, and the core has a deformation amount when applying an initial load of 98 N to a final load of 1275 N of 2.5 to 4.5mm, a hardness distribution such that the center point is the softest and the outer portion has higher hardness in order, a hardness difference in Shore D hardness between the center hardness and surface hardness of 15 to 45, a center hardness in Shore D hardness of 20 to 50, and a surface hardness in Shore D hardness of 45 to 72.

2. The golf ball according to claim 1, wherein the cover has a thickness of 0.2 to 1.5 mm and a hardness in Shore D hardness of 30 to 55.

3. The golf ball according to claim 1, wherein the cover is formed from a material having a value of the maximum load of 1.6 to 2.7 kN at an impact energy of 47.3 J in penetration and impact fatigue tests.

4. The golf ball according to claim 1, wherein the cover is formed from a material having a value of the maximum load of 1.6 to 2.5 kN at an impact energy of 47.3 J in penetration and impact fatigue tests.

5. The golf ball according to claim 1, wherein the cover has a thickness of 0.5 to 1.5 mm and a hardness in Shore D hardness of 32 to 52.

6. The golf ball according to claim 1, wherein the cover has a thickness of 0.8 to 1.4 mm and a hardness in Shore D hardness of 35 to 50.

* * * * *